US005136489A

United States Patent [19]

Cheng et al.

[11] Patent Number: 5,136,489

[45] Date of Patent: Aug. 4, 1992

[54] PROJECTIVE LAMP

[76] Inventors: Hsiang T. Cheng, 15 Houchoutzu, Tamsui, Taiwan; Gary Hsieh, 18 Country Meadow Rd., Rolling Hills Estates, Calif. 90274

[21] Appl. No.: 717,055

[22] Filed: Jun. 18, 1991

[51] Int. Cl.[5] ..... F21V 29/00

[52] U.S. Cl. ..... 362/294; 362/285; 362/372; 362/373; 362/418

[58] Field of Search ..... 362/125, 218, 220, 226, 362/285, 294, 372, 373, 418, 419, 424, 427

[56] References Cited

U.S. PATENT DOCUMENTS

| | | | |
|---|---|---|---|
| 4,258,413 | 3/1981 | Mausser | 362/427 |
| 4,327,402 | 4/1982 | Aubrey | 362/418 |
| 4,333,132 | 6/1982 | Paley | 362/427 |
| 4,497,016 | 1/1985 | Sachse | 362/373 |
| 4,503,360 | 3/1985 | Bedel | 362/373 |
| 4,881,157 | 11/1989 | Pahl | 362/372 |
| 4,930,054 | 5/1990 | Krebs | 362/373 |

*Primary Examiner*—Allen M. Ostrager
*Assistant Examiner*—Sue Hagarman
*Attorney, Agent, or Firm*—Bacon & Thomas

[57] ABSTRACT

A projection lamp capable of being easily assembled to a screw socket and is both extensively and pivotally adjustable. The lamp includes a lamp housing having a conductive threaded cap an two opposite inner guiding rails, and annular member having two opposite wings capable of being slidably positioned along the guiding rails, and a lamp body pivotally connected under the annular member and having a reflective shade and a bulb electrically connected to the threaded cap.

3 Claims, 4 Drawing Sheets

PROJECTIVE LAMP

BACKGROUND OF THE INVENTION

The present invention relates to an electrical lamp, and more particularly to a projection lamp.

A projection lamp using a halogen bulb occupies a small space, has a concentrated light and can easily be put into use when desired so that it is extensively used in a showroom or a display area of a store or a storehouse for illuminating a product sample or just for general illumination. Such a lamp generally includes a lamp housing and a lamp body with the former generally attached to an electrical rail on the ceiling of a room and thus require wiring and installation which are both troublesome and time-consuming. In addition, the lamp body has only limited adjustability since the lamp body is pivotally connected to the lamp housing by means of a side bracket that does not permit extendibility.

SUMMARY OF THE INVENTION

It is therefore an object of the present invention to provide a projection lamp having a lamp body that is extendible with respect to a lamp housing thereof.

It is further an object of the present invention to provide a projection lamp capable of being easily attached to a screw socket.

According to the present invention, a projection lamp includes a lamp housing having a conductive threaded cap and two opposite inner guiding rails, an annular member having two opposite wings capable of being slidably positioned along the guiding rails, and a lamp body pivotally connected under the annular member and having a reflective shade and a bulb electrically connected to the threaded cap.

The present invention may best be understood through the following description with reference to the accompanying drawing, in which:

DETAILED DESCRIPTION OF THE PREFERRED EMBODIMENT

Figure 1:
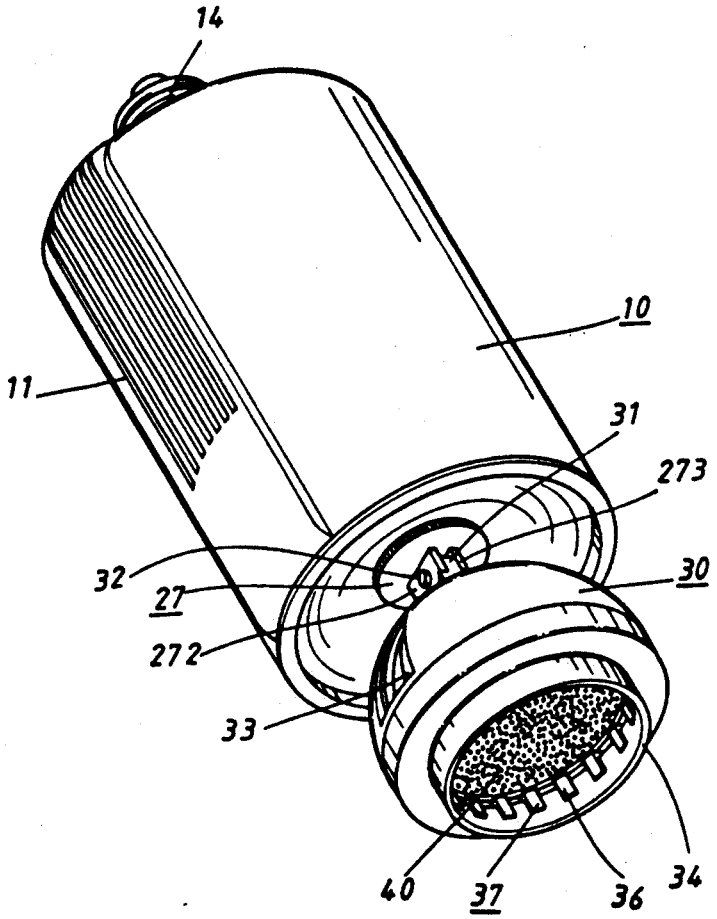
FIG. 1 is a perspective view showing a preferred embodiment of a projection lamp according to the present invention.
Figure 2:
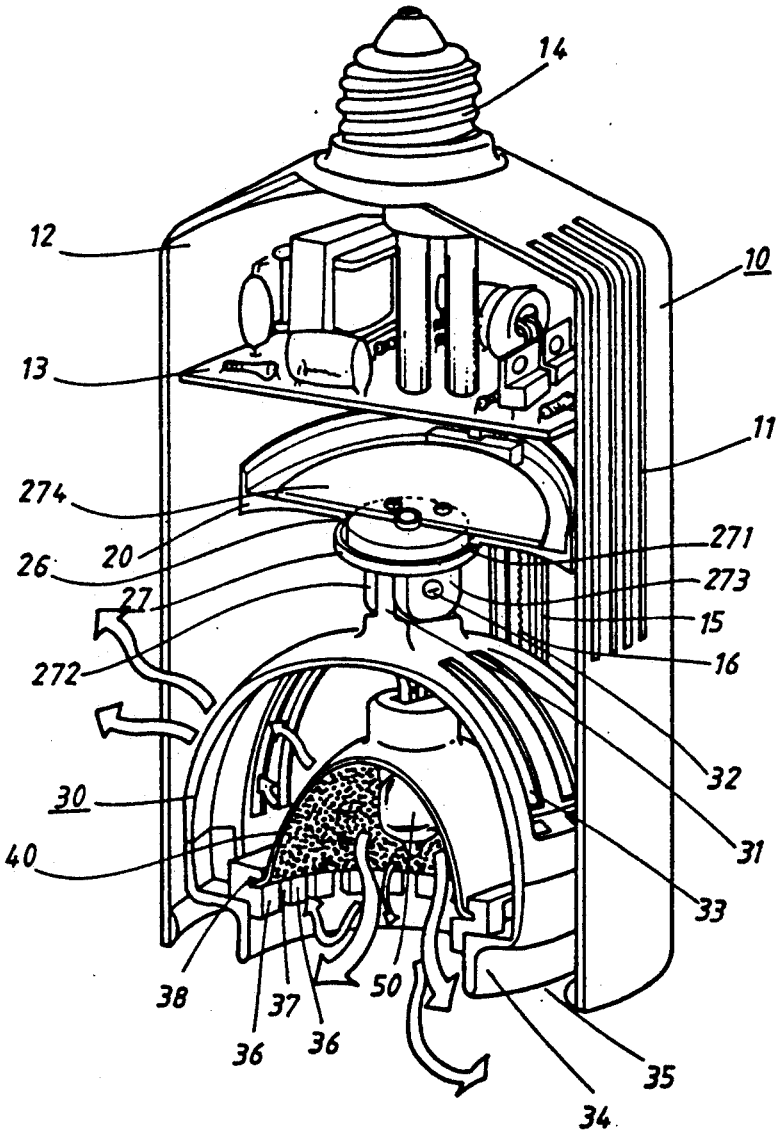
FIG. 2 is a fragmentary view showing the lamp in FIG. 1.
Figure 3:
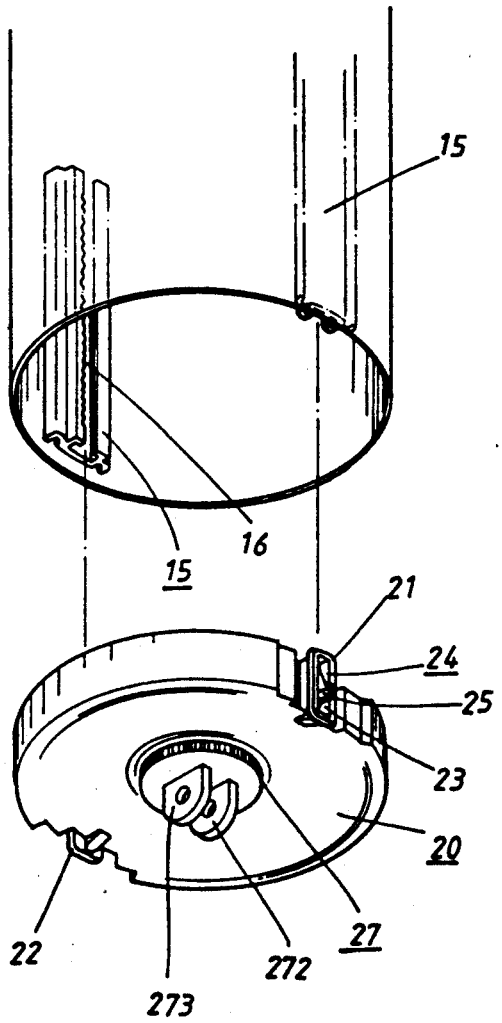
FIG. 3 is a partly perspective view showing a lamp housing and an annular medium of the lamp in FIG. 1.

Referring now to FIGS. 1-3, a projection lamp according to the present invention includes a generally cylindrical lamp housing 10, an annular member 20 and a lamp body assembly 30, 40 and 50. Lamp housing 10 includes a plurality of heat-dissipating side slots II, an upper compartment 12 accommodating therein a circuit board 13 and electrical elements, a conductive threaded cap 14 for attachment in a screw socket (not shown), and two opposite inner vertical guiding rails 15 one of which is provided with a vertical toothed portion 16.

Annular member 20 is disposed beneath circuit board 13 and has two opposite wings 21, 22 capable of being slidably positioned along guiding rails 15, and a central hole 26. Wings 21, 22 are respectively recessed at areas 23 for receiving therein a pair of V-shaped resilient members 24 having a projecting portion 25 capable of engaging with and sliding along toothed portion 16. A connecting member 27 includes a disk portion 271 rotatably received in central hole 26, two downwardly extending lugs 272, 273, and a circular plate 274 placed above annular medium 20 and screwed to disk portion 271.

Lamp body assembly 30, 40 and 50 includes a generally semi-spherical body housing 30, a reflective shade 40 and a halogen bulb 50 electrically connected to threaded cap 14. Body housing 30 includes a top lug 31 pivotally pinned to and between lugs 272, 273, side heat-dissipating slots 33, a constricted lower portion 34 cooperating with lamp housing 10 to define therebetween a clearance 35 capable of receiving therein fingers of a person, and an a ring member 36 which is seated on lower portion 34 and has a plurality of heat-dissipating slots 37 and an annular groove 38 written which a reflective shade 40 is received and generally centrally positioned in body housing 30 above ring member 36.

Figure 4:
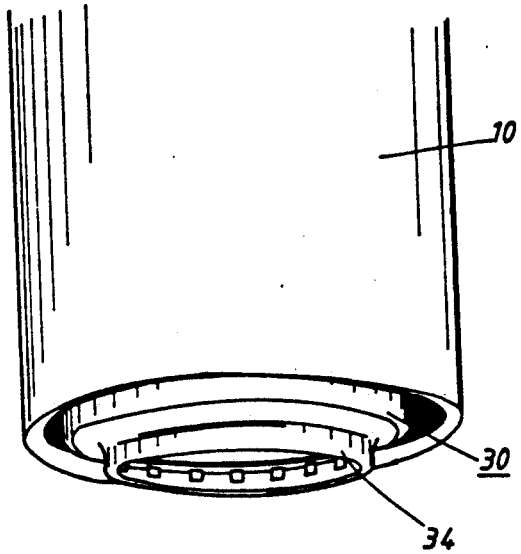
FIG. 4 is a partly perspective view showing a projective lamp in FIG. 1.

As shown in FIGS. 2 and 4, when assembly 30, 40 and 50 is received in lamp housing 10, the light emitted from bulb 50 illuminates downwardly and the heat generated by the bulb light dissipate upwardly through heat-dissipating slots 37, 33 and 11.

Figure 6:
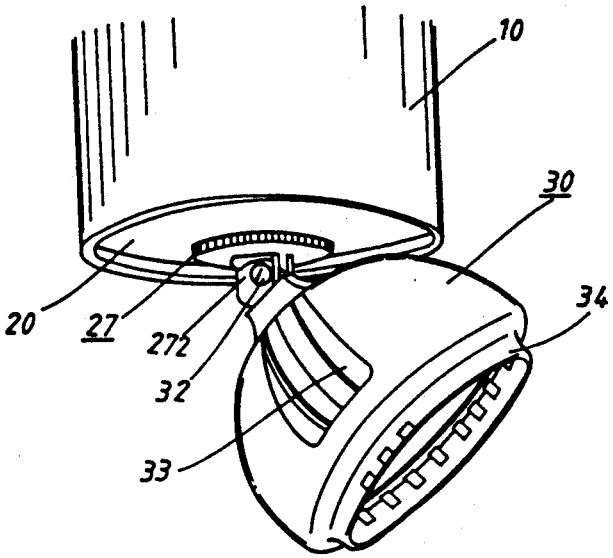
FIG. 6 is an additional partly perspective view showing the lamp in FIG. 1.
Figure 5:
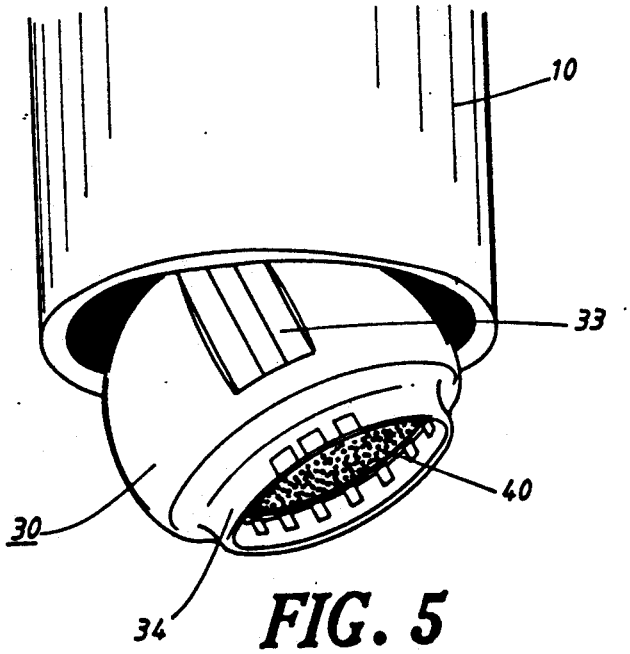
FIG. 5 is a further partly perspective view showing the lamp in FIG. 1.

As shown in FIGS. 2, 5 and 6, since wings 21, 22 are slidably positioned along guiding rails 15, assembly 30, 40 and 50 can thus be translated along or extended and positioned in engagement with guiding rails 15, that is, assembly 30, 40 and 50 can be pushed into or pulled out of housing 10. Since disk portion 271 is rotatably received in central hole 26 and top lug 31 is pivotally fixed to lugs 272, 273, assembly 30, 40 50 can also be both pivotally and rotatable adjusted with respect to lamp housing 10.

Through the above description, it should now become readily apparent how and why the present invention can achieve the its desired objects.

What is claimed is:

1. A projection lamp comprising;

a) a lamp housing including a conductive threaded cap for attachment to a screw socket, two opposed inner guiding rails, and at least one guiding rail including a toothed portion;

b) an annular member including a pair of opposed wings for engaging the guiding rails and permitting the annular member to slide and be positioned along the rails, and a central hole;

c) a compartment within the lamp housing positioned between the threaded cap and the annular member for containing electrical elements;

d) a resilient member recessed within one wing for permitting the annular member to slide and be positioned along the guide rail;

e) a lamp body including a reflective shade and a bulb electrically connected to the threaded cap; and f) a connecting member rotatably secured within the central hole of the annular member and the lamp body being pivotally connected to the connecting member.

2. A projection lamp comprising:

a) a lamp housing including a conductive threaded cap for attachment to a screw socket and two opposed inner guiding rails;

b) an annular member including two opposite wings for engaging the guiding rails and permitting the annular member to slide an be positioned along the rails, and a central hole;

c) a lamp body pivotally connected to the annular member and including a generally semispherical body housing, a ring member provided with an annular groove, a reflective shade engaged within the annular groove and extending above the ring member, and a bulb electrically connected to the threaded cap.

3. The projection lamp of claim 2 wherein each of the lamp housing, body housing and ring member includes a plurality of heat-dissipating slots formed therein.

* * * * *